US009387984B1

(12) United States Patent
Lovett

(10) Patent No.: US 9,387,984 B1
(45) Date of Patent: Jul. 12, 2016

(54) REUSEABLE AND REVERSIBLE APERTURE-HINGED LID FOR DUMPSTERS

(71) Applicant: Jason K Lovett, Griffin, GA (US)

(72) Inventor: Jason K Lovett, Griffin, GA (US)

( * ) Notice: Subject to any disclaimer, the term of this patent is extended or adjusted under 35 U.S.C. 154(b) by 0 days.

(21) Appl. No.: 14/733,005

(22) Filed: Jun. 8, 2015

(51) Int. Cl.
*B65D 43/16* (2006.01)
*B65F 1/14* (2006.01)
*B65D 43/14* (2006.01)

(52) U.S. Cl.
CPC ..... *B65F 1/1646* (2013.01)

(58) Field of Classification Search
CPC ..... B65D 43/165; B65F 1/1421; B65F 1/16; B65F 1/1623; B65F 1/1646
USPC ..... 220/810, 287, 817, 844, 908
See application file for complete search history.

(56) References Cited

U.S. PATENT DOCUMENTS 4,445,623 A * 5/1984 Kolling ..... B29C 41/04 220/844
4,650,089 A * 3/1987 Sanders ..... B65F 1/1646 220/848
5,244,109 A * 9/1993 Mullett ..... B65F 1/16 220/212
5,248,057 A * 9/1993 Taylor ..... B65F 1/1623 220/263
5,975,345 A * 11/1999 Taylor ..... B65F 1/16 220/826
7,198,166 B2 * 4/2007 Sholinder ..... B65F 1/02 220/4.28
7,387,350 B2 * 6/2008 Killinger ..... A45C 13/02 220/817
7,743,937 B2 * 6/2010 Taylor ..... B65F 1/16 206/505
8,141,921 B2 * 3/2012 Apps ..... B65F 1/122 220/908
2003/0141312 A1 * 7/2003 Lemajeur ..... B65F 1/16 220/826
2003/0209557 A1 * 11/2003 Taylor ..... B65F 1/16 220/844
2005/0224507 A1 * 10/2005 Gavin ..... B29C 51/087 220/836
2012/0199590 A1 * 8/2012 Therrien ..... B65F 1/122 220/564

* cited by examiner

*Primary Examiner* — J. Gregory Pickett
*Assistant Examiner* — Niki M Eloshway
(74) *Attorney, Agent, or Firm* — J. T. Hollin, Attorney-at-Law, P.C.

(57) ABSTRACT

Disclosed is a lid commonly used for attachment atop dumpsters, trash bins, or waste containers of the type having a circular cross-sectioned lid rod. The lid comprises a three-dimensional rectangular structure reinforced by contoured ribs running lengthwise and further having the capability of being hingedly operated at either the front end or the rear end of the lid. Co-axial, horizontally-oriented circular apertures are provided proximate the front end and rear end of each of the ribs. The apertures permit the hinged attachment of the lid to the waste containers. In this manner, an advantage accrues to a commercial user in that, after a certain amount of wear and tear, the lid may be removed from the waste container and the opposite aperture end may then be attached to the lid rod and used for another extended period of time.

4 Claims, 5 Drawing Sheets

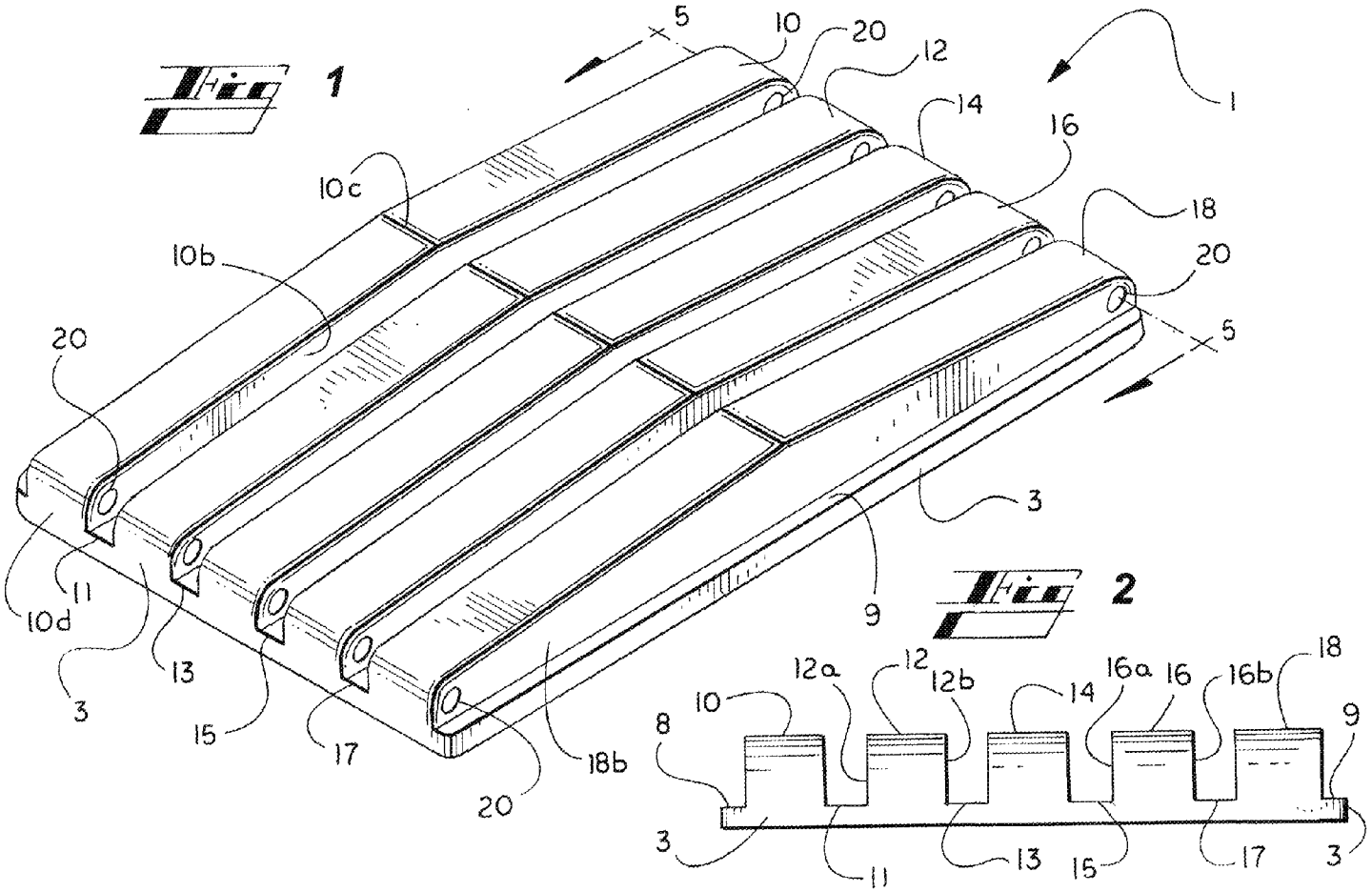
1
2
1
2
3
5
8
9
10
10a
10b
10c
10d
11
12
12a
12b
13
14
15
16
16a
16b
17
18
18b
20

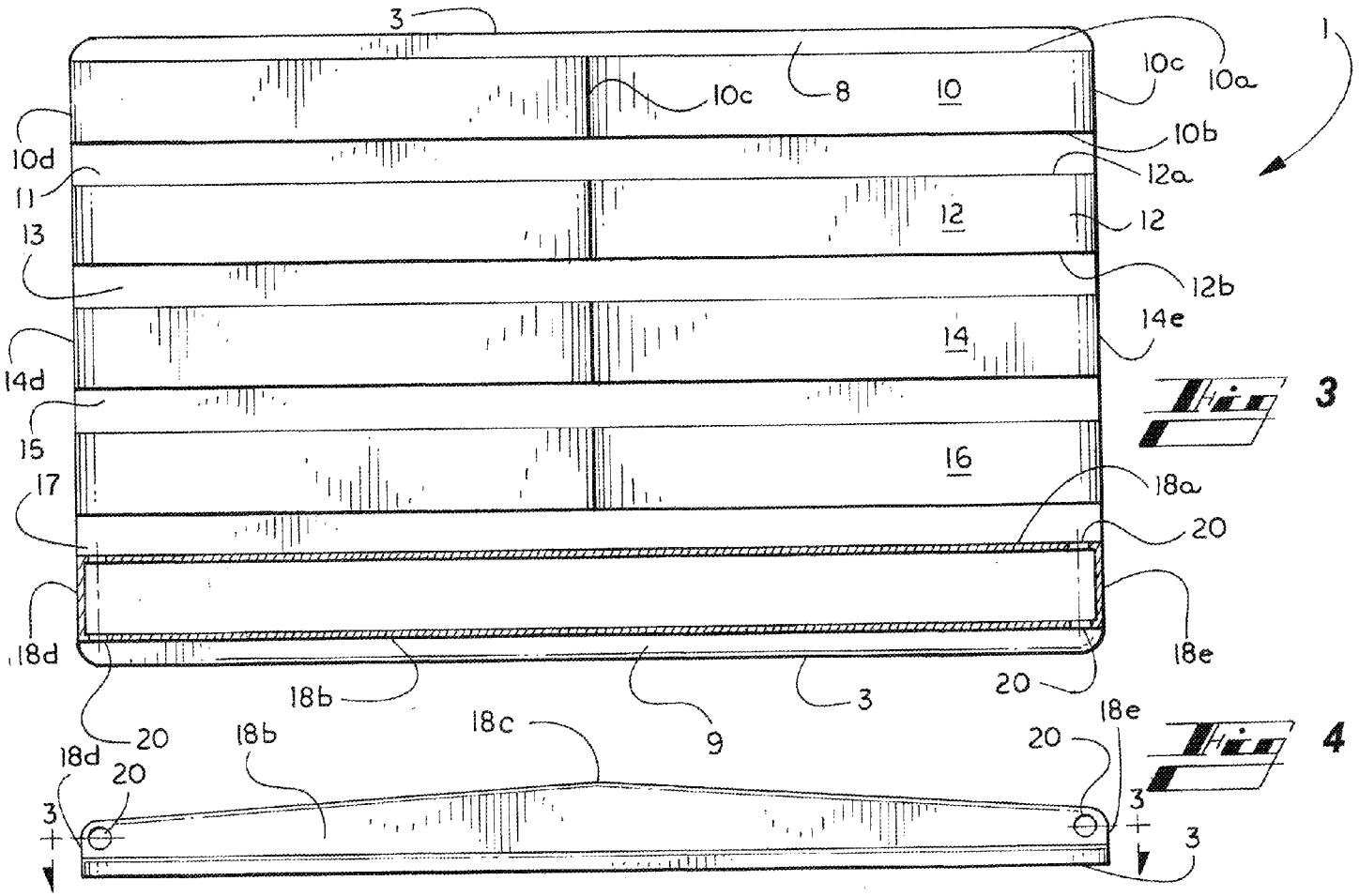
1
10a
10c
10b
12a
12
12b
14e
3
18a
20
18e
4
3
10
12
14
16
8
10c
3
9
18c
18b
18b
20
20
18d
3
10d
11
13
14d
15
17
18d

REUSEABLE AND REVERSIBLE APERTURE-HINGED LID FOR DUMPSTERS

CROSS-REFERENCES TO RELATED APPLICATIONS

None

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

BACKGROUND OF THE INVENTION (1) Field of the Invention

The present inventive concept relates to a specially designed reversibly-hinged mechanism for use in conjunction with a lid commonly attached atop a dumpster, garbage bin, or similar trash container having a horizontally-oriented circular cross-sectioned lid rod. More particularly, one end of the disclosed lid is capable of being detached and the opposite end thereupon attached to atop the container, utilizing the opposite hinged-enabled end of the lid for purposes of increased durability or recycling.

(2) Description of the Related Art, Including Information Disclosed Under 37 CFR 1.97 and 1.98.

U.S. Published Patent Application #3011/0049149; (3 Mar. 3011). An automatic opening-and-closing lid for a garbage bin, the automatic opening-and-closing lid comprises a base member including an opening for user throwing trash into the bin therefrom and first and second annular flanges; a lid installed to the opening of the base member and able to pivot with respect to the base member; a control means installed to the base member and including a power source for power supply, a control panel, a driving member electrically connected to the control panel, a driven member and first and second sensor wires electrically connected to the power source, with the first and second sensor wires respectively disposed in the first and second annular flanges; and a sensing region formed proximal to the first and second sensor wires.

U.S. Published Patent Application #2013/0306637; (21 Nov. 2013). Certain types of garbage bins that allow for automated garbage collection are becoming increasingly prevalent. These bins come with a hinged lid that will open when the garbage bin is lifted by mechanical arms. This invention discloses a lock that can be attached to the lid of the garbage bin that will keep the lid closed when the bin is standing upright but will automatically release when the bin is tilted at an angle.

BRIEF SUMMARY OF THE INVENTION

The disclosed inventive concept presents a lid that is commonly hingedly-attached atop one edge of rubbish containers such as dumpsters, trash bins, or garbage cans. The invention disclosed features an essentially three-dimensional rectangular structure reinforced by contoured ribs running lengthwise. The hinge portion is made functional at either the front end or rear end of the lid by co-axial circular apertures drilled through the ribs at the front end of the lid or through the rear end of the ribs at the rear end of the lid. Alternatively, the same basic lid structure may be made reversibly functional by a plurality of integral, co-axial barrel hinges attached at both ends of the lid.

By either of the two disclosed embodiments, an advantage accrues to a commercial user in that, after a certain amount of wear and tear, or strictly for recycling of the lid, it may be removed from the trash container and the opposite hinged end may then be attached and used for another extended period of time.

BRIEF DESCRIPTION OF THE VIEWS OF THE DRAWINGS

FIG. 1 illustrates a perspective view of the outer surface of the inner-hinged lid.

FIG. 2 presents a direct view of the first end of the inner-hinged lid, further showing each of the five ribs and alleys comprising the inner-hinged lid.

FIG. 3 illustrates a direct view of the top, or plan view of the inner-hinged lid, including a cutaway view of the fifth rib of the inner-hinged lid, as seen from the perspective created by section line 3-3 of FIG. 4.

FIG. 4 depicts a side view of the inner-hinged lid, as seen looking directly at the fifth rib of the inner-hinged lid and the right-side rim.

DETAILED DESCRIPTION OF THE INVENTION

Figure 5:
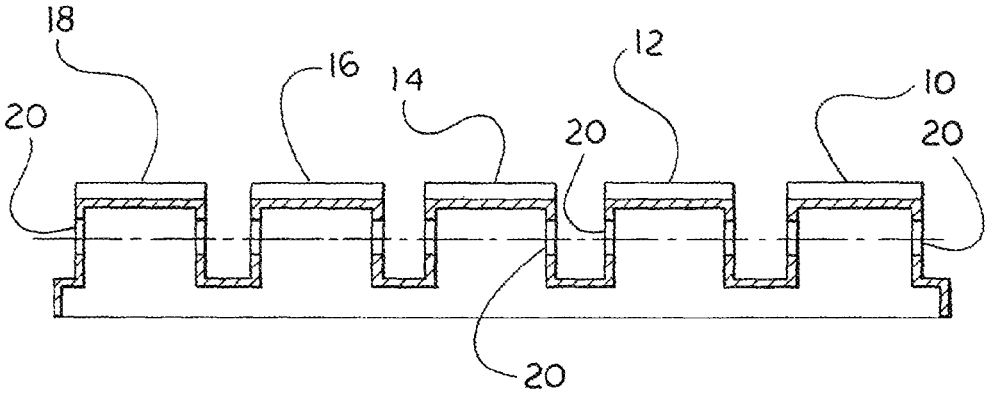
FIG. 5 shows a cutaway view of the inner-hinged lid, as seen from the perspective created by section line 5-5 of FIG. 1.

The objects, features, and advantages of the inventive concept presented in this application are more readily understood when referring to the accompanying drawings. The drawings, totaling nine figures, show the basic components and functions of the preferred embodiment and at least one alternate embodiment. In the several figures, like reference numbers are used in each figure to correspond to the same component as may be depicted in other figures.

The discussion of the present inventive concept will be initiated with FIG. 1, which illustrates a perspective view of the outer surface of the preferred embodiment of an inner-hinged lid 1. The inner-hinged lid 1 is shown being separated from a dumpster or trash bin for which it is designed to be attached. In this embodiment there are shown five ribs: a first rib 10, a second rib 12, a third rib 14, a fourth rib 16, and a fifth rib 18. Each of the ribs 10, 12, 14, 16, 18 runs lengthwise (the longer dimension) of the inner-hinged lid 1. The leftmost portion of the inner-hinged lid 1 is the designated front end of the inner-hinged lid 1. The rightmost portion of the inner-hinged lid 1 is designated as the rear end.

FIG. 2 is a front-end view of the inner-hinged lid 1, showing the front ends of each of the five ribs 10, 12, 14, 16, 18. Each rib 10, 12, 14, 16, 18, is essentially horizontally oriented, as is shown in FIG. 1 and FIG. 2. There exists a slight peak of each rib 10, 12, 14, 16, 18 outer surface at the mid-length of each rib 10, 12, 14, 16, 18, as is exemplified at point 10*c* of the first rib 10.

Each rib 10, 12, 14, 16, 18 is given a three-dimensional structure by virtue of left and right vertical walls 10*a* & 10*b*, 12*a* & 12*b*, 14*a* & 14*b*, 16*a* & 16*b*, 18*a* & 18*b* (all the vertical walls are not labeled, due to limited space in FIG. 1 and FIG. 2). FIG. 2 does show, for purposes of illustration, the respective left and right vertical walls of the second rib 12, designated as 12*a*, and 12*b*; and the respective left and right vertical walls of the fourth rib 16, designated as 16*a*, 16*b*. Further, between the left and right vertical walls of neighboring ribs, there exist four lengthwise floors: 11, 13, 15, and 17, as is illustrated in both FIG. 1 and FIG. 2.

FIG. 1 also depicts a right flange 9 running orthogonally and parallel to the right wall 18*b* of the fifth rib 18. The right flange 9 further bends downward to form a vertical rim 3, said rim 3 being formed along the entire bottom perimeter of the inner-hinged lid 1. Also, in viewing FIG. 2, there is shown a profile view of a left flange 8 which, similarly to the right flange 9, runs orthogonally and parallel to the left wall of the first rib 10. The left flange 8 bends downward to form the left portion of the perimetral rim 3.

Shown in FIG. 1 are the front ends of each of said ribs 10, 12, 14, 16, 18, (generally depicted by sub-letter d in FIG. 3, and further, as exemplified by item 10*d* of FIG. 1). The vertical walls 10*a* & 10*b*, 12*a* & 12*b*, 14*a* & 14*b*, 16*a* & 16*b*, 18*a* & 18*b*, and floors 11, 13, 15, and 17, transition to a downwardly arcuate shape culminating in a juncture with the perimetral rim 3 of the inner-hinged lid 1. In viewing FIG. 1, there is illustrated the front ends of each of said vertical walls 10*a* & 10*b*, 12*a* & 12*b*, 14*a* & 14*b*, 16*a* & 16*b*, 18*a* & 18*b* constructed with co-axial circular apertures 20 proximate the front end of each of said vertical walls 10*a* & 10*b*, 12*a* & 12*b*, 14*a* & 14*b*, 16*a* & 16*b*, 18*a* & 18*b*. Further, in FIG. 1, there is illustrated co-axial circular apertures 20 constructed proximate the rear end of each of said vertical walls 10*a* & 10*b*, 12*a* & 12*b*, 14*a* & 14*b*, 16*a* & 16*b*, 18*a* & 18*b* (the rear ends generally depicted by sub-letter e, as exemplified by items 14*e* and 18*e* of FIG. 3).

FIG. 3 depicts a top view of the inner-hinged lid 1, again showing the five parallel ribs 10, 12, 14, 16, 18 and the corresponding floors 11, 13, 15, and 17. A sectional view of the fifth rib 18 is depicted, as indicated by section line 3-3 of FIG. 4. In FIG. 4 there is shown the configuration and profile of the left wall 18*b*. The lengthwise flanges 8, 9 are further shown in FIG. 3. It is also noted that FIG. 4 illustrates the mid-length peak 18*c* of the fifth rib 18, the perimetral rim 3 of the inner-hinged lid 1, the front end aperture 20, and the rear end aperture 20 of the fifth rib 18.

FIG. 5 depicts a cross-sectional view of the profile of the rear end of the ribs 10, 12, 14, 16, 18 of the inner-hinged lid 1 as seen from section line 5-5 of FIG. 1. The essentially hollow interior of the ribs 10, 12, 14, 16, 18 and the positioning and alignment of the circular apertures 20 are both shown in FIG. 5.

The structure of the inner-hinged lid 1 permits the front ends 10*d*, 12*d*, 14*d*, 16*d*, and 18*d*, of each of said ribs to accommodate a circular cross-sectioned lid rod of the type typically attached to an upper surface of a dumpster, garbage receptacle, or trash bin. The circular cross-sectioned lid rod is installed through the circular apertures 20 of said front ends 10*d*, 12*d*, 14*d*, 16*d*, and 18*d*. Once the lid rod is re-secured to the container, the lid rod, in alignment with the circular apertures 20 then provides a hinge axis for opening and closure of the inner-hinged lid 1.

Conversely, the structure of the inner-hinged lid 1 also permits the rear ends 10*e* 12*e*, 14*e*, 16*e*, and 18*e* of each of said ribs to accommodate the circular cross-sectioned lid rod of the type typically integral to an upper surface of a dumpster, garbage receptacle, or trash bin to be inserted through the circular apertures 20 of said rear ends 10*e*, 12*e*, 14*e*, 16*e*, and 18*e*. The overall dimensions of the inner-hinged lid 1, along with the number of ribs and circular apertures 20 may be increased, as necessary to correspond to larger sizes of waste containers.

In summary, after a certain amount of wear and tear, or strictly for recycling of the inner-hinged lid 1, it may be removed and the opposite arrangement of circular apertures 20 may then be used, in conjunction with the circular cross-sectioned lid rod, to provide an essentially new hinge axis to function by virtue of the securement of the circular cross-sectioned lid rod to the opposite end of the inner-hinged lid 1, at the option of a user of said dumpster, garbage receptacle, or trash bin.

Figures 6, 7:
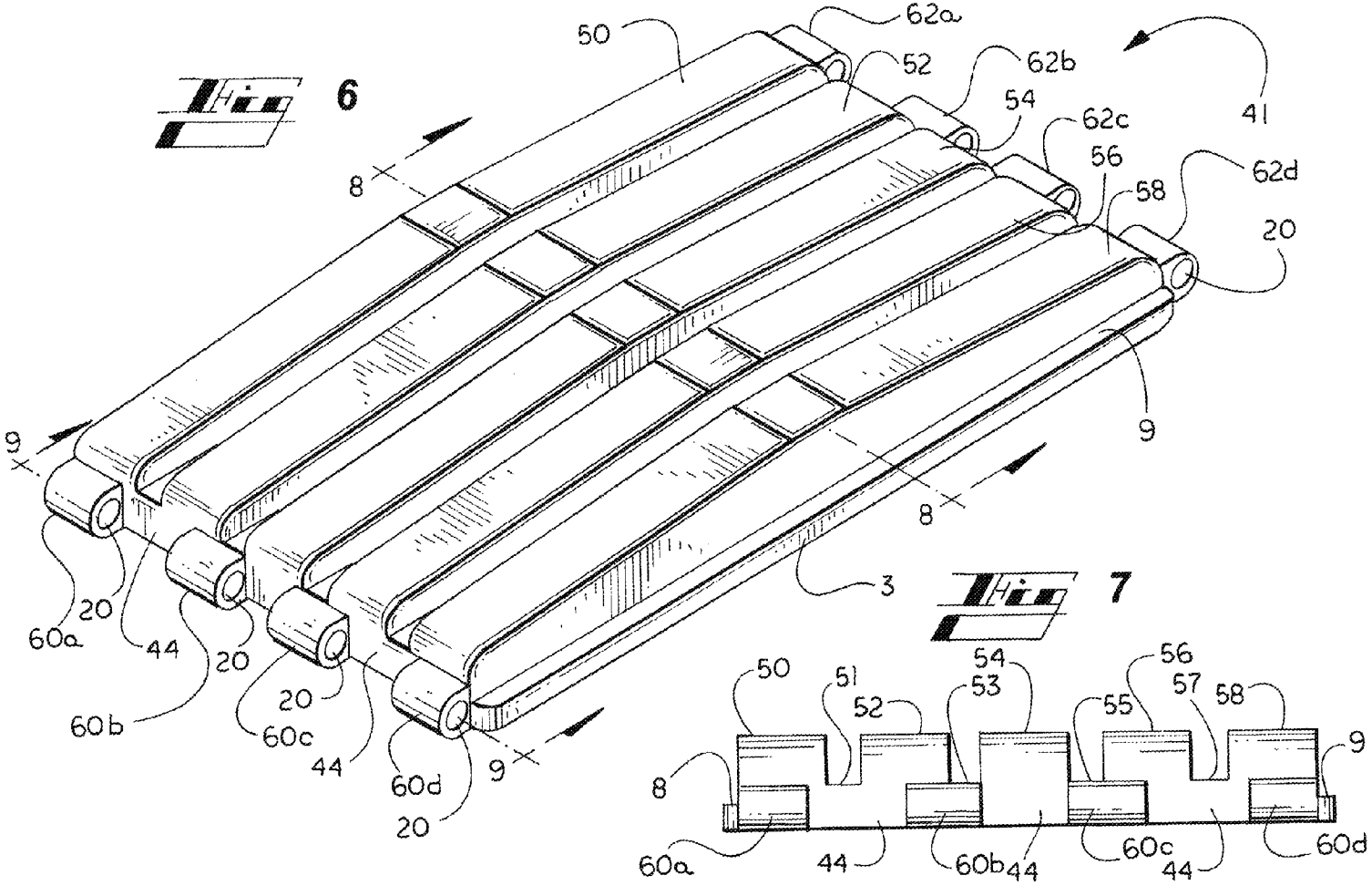
FIG. 6 illustrates a direct view of the top, or plan view of an outer-hinged lid.
FIG. 7 depicts a side view of the outer-hinged lid, as seen looking directly at the fifth rib.

FIG. 6 illustrates a perspective view of the outer surface of an alternate embodiment of the inventive concept, referred to as an outer-hinged lid 41. The outer-hinged lid 41 is shown separate from a dumpster, trash bin, or similar container for which it is designed to be attached. In this alternate embodiment, there are shown five ribs: a first rib 50, a second rib 52, a third rib 54, a fourth rib 56, and a fifth rib 58. Each of the ribs 50, 52, 54, 56, 58 runs lengthwise (the longer dimension) of the outer-hinged lid 41 and further, comprise vertical walls and lengthwise floors 51, 52, 53, 54, 57, similar to the inner-hinged lid 1. In FIG. 6, the leftmost portion of the outer-hinged lid 41 is designated as the front end 44. The rightmost portion (not visible) of the outer-hinged lid 41 is designated as the rear end 45.

The outer-hinged lid 41 comprises by four symmetrically-spaced front barrel hinges 60*a*, 60*b*, 60*c*, 60*d* at the front end 44 of each of said ribs 50, 52, 54, 56, 58. The front barrel hinges 60*a*, 60*b*, 60*c*, 60*d* are constructed with co-axial circular apertures 20 so as to allow the front barrel hinges 60*a*, 60*b*, 60*c*, 60*d* to accommodate a circular cross-sectioned lid rod of the type typically attached to an upper surface of a dumpster, garbage receptacle, or similar container. The circular cross-sectioned lid rod may be fitted through the front barrel hinges 60*a*, 60*b*, 60*c*, 60*d*, and once the lid rod is re-secured to the container, the lid rod, in alignment with the front barrel hinges 60*a*, 60*b*, 60*c*, 60*d* then provides a hinge axis for opening and closure of the outer-hinged lid 41. The overall dimensions of the outer-hinged lid 41, along with the number of front barrel hinges 60*a*, 60*b*, 60*c*, 60*d* may be increased, as necessary to correspond to larger sizes of waste containers.

The outer-hinged lid 41 further comprises four symmetrically-spaced rear barrel hinges 62*a*, 62*b*, 62*c*, 62*d* at the rear ends 45 of each of said ribs 50, 52, 54, 56, 58. The rear barrel hinges 62*a*, 62*b*, 62*c*, 62*d* are constructed with co-axial circular apertures 20 so as to allow the rear barrel hinges 62*a*, 62*b*, 62*c*, 62*d* to accommodate a circular cross-sectioned lid rod of the type typically attached to an upper surface of a dumpster, garbage receptacle, or similar container.

The circular cross-sectioned lid rod may alternatively be fitted through the rear barrel hinges 62*a*, 62*b*, 62*c*, 62*d*, and once the lid rod is re-secured to the waste container, the lid rod, in alignment with the rear barrel hinges 62*a*, 62*b*, 62*c*, 62*d* then provides a hinge axis for opening and closure of the outer-hinged lid 41. The overall dimensions of the outer-hinged lid 41, along with the number of rear barrel hinges 62*a*, 62*b*, 62*c*, 62*d* may be increased, as necessary to correspond to larger sizes of waste containers.

Figure 8:
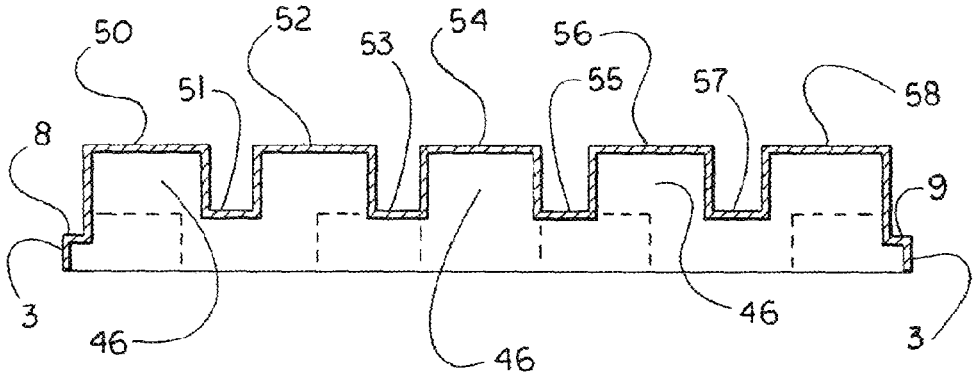
FIG. 8 shows a cutaway view of the outer-hinged lid, as seen from the perspective created by section line 8-8 of FIG. 6.

FIG. 8 is a cross-sectional view of the mid-length point of the outer-hinged lid 41, as seen from section line 8-8 of FIG. 6. The essentially hollow interior of the ribs 50, 52, 54, 56, 58 exposes the inner surfaces 46 of the ribs, as is noted in FIG. 8.

Figure 9:
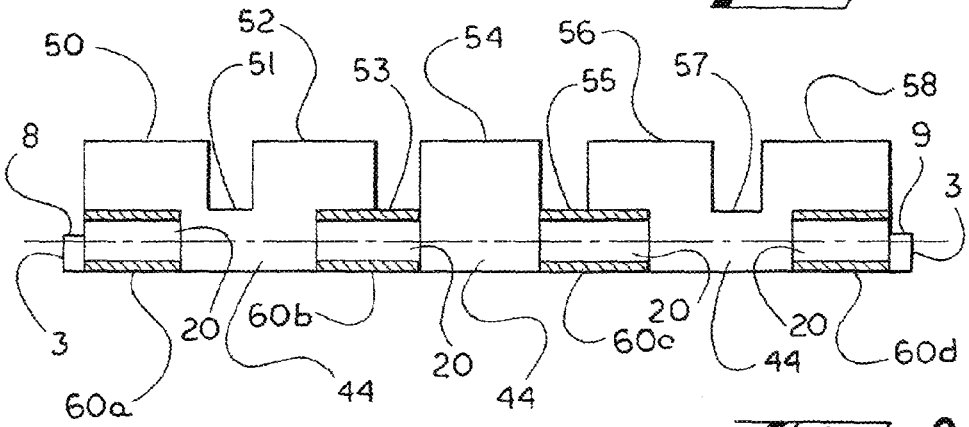
FIG. 9 presents a cutaway view of the outer-hinged lid, as seen from the perspective created by section line 9-9 of FIG. 6.

FIG. 9 is a cross-sectional front-end 44 view of the outer-hinged lid 41, as seen from section line 9-9 of FIG. 6. FIG. 9 shows the front ends 44 of each of the five ribs 50, 52, 54, 56, 58, in addition to showing a cross-section of the circular apertures 20 of each of the front barrel hinges 60*a*, 60*b*, 60*c*, 60*d*. Each rib 50, 52, 54, 56, 58 is essentially horizontally oriented, as is shown in FIG. 6 and FIG. 7.

While preferred embodiments of the present inventive concept have been shown and disclosed herein, it will be obvious to those persons skilled in the art that such embodiments are presented by way of example only, and not as a limitation to the scope of the inventive concept. Numerous variations, changes, and substitutions may occur or be suggested to those skilled in the art without departing from the intent, scope, and totality of this inventive concept. Such variations, changes, and substitutions may involve other features which are already known per se and which may be used instead of in combination with, or in addition to features already disclosed herein. Accordingly, it is intended that this inventive concept be inclusive of such variations, changes, and substitutions, and by no means limited by the scope of the claims presented herein.

What is claimed is:

1. A lid for attachment atop dumpsters, garbage receptacles, and trash bins, said dumpsters, garbage receptacles, and trash bins, all of the type having a horizontally-oriented circular cross-sectioned lid rod, said lid rod attached parallel to at least one upper edge of said dumpster, garbage receptacle, or trash bin, said lid having an outer surface, an inner surface, a front end, which is attachable to said lid rod, a left side, a rear end, which is attachable to said lid rod, and a right side, the lid further comprising:

a rectangular-shaped structure having, when viewed in a horizontal orientation, a plurality of essentially horizontal, equal-length, parallel ribs running along a long dimension of the structure, each rib inherently defined by a downwardly vertical, lengthwise left wall, and a downwardly vertical, lengthwise right wall, a front end, a rear end, and, with the exception of, a leftmost rib and a rightmost rib, each left wall and right wall orthogonally and integrally joined to a horizontal, lengthwise floor running the same length as each of said ribs;

the leftmost and rightmost ribs constructed with outer vertical walls, said walls being orthogonally and integrally joined to a lengthwise horizontal left flange and lengthwise horizontal right flange, respectively, and said left and right flanges further being bent orthogonally downward to form a left rim and a right rim, respectively; further a vertically-oriented lid front rim formed by front ends of each of said ribs, vertical walls, and floors transitioning to a downwardly arcuate shape and a vertically-oriented lid rear rim formed by rear ends of each of said ribs, vertical walls, and floors transitioning to a downwardly arcuate shape, whereby said front rim, rear rim, left rim, and right rim comprise one continuous perimetral rim;

the front ends of each of said vertical walls constructed with a means for the horizontal attachment and securement to the lid rod of said dumpster, garbage receptacle, or trash bin;

the rear ends of each of said vertical walls constructed with a means for the horizontal attachment and securement to the lid rod of said dumpster, garbage receptacle, or trash bin; thereby said lid rod providing a hinge axis for opening said lid and thereby exposing the entirety of the opening of the dumpster, garbage receptacle, or trash bin and for closure of said lid, said hinge axis functioning by virtue of either the securement of the lid rod to the front end of said lid or securement of the lid rod to the rear end of said lid, at the option of a user of said dumpster, garbage receptacle, or trash bin.

2. A lid for attachment atop dumpsters, garbage receptacles, and trash bins, said dumpsters, garbage receptacles, and trash bins of the type having a horizontally-oriented circular cross-sectioned lid rod, said lid rod attached parallel to at least one upper edge of said dumpster, garbage receptacle, or trash bin, said lid having an outer surface, and inner surface, a front end which is attachable to said lid rod, a left side, a rear end which is attachable to said lid rod, and a right side, the lid further comprising:

a rectangular-shaped structure having, when viewed in a horizontal orientation, five essentially horizontal, equal-length, parallel ribs running along a long dimension of the structure, each rib inherently defined by a downwardly vertical, lengthwise left wall, and a downwardly vertical, lengthwise right wall, a front end, a rear end, and, with the exception of, a leftmost rib and a rightmost rib each left wall and right wall orthogonally and integrally joined to a horizontal, lengthwise floor running the same length as each of said ribs;

the leftmost and rightmost ribs constructed with outer vertical walls, said walls being orthogonally and integrally joined to a lengthwise horizontal left flange and lengthwise horizontal right flange, respectively, and said left and right flanges further being bent orthogonally downward to form a left rim and a right rim, respectively; further a vertically-oriented lid front rim formed by front ends of each of said ribs, vertical walls, and floors transitioning to a downwardly arcuate shape and a vertically-oriented lid rear rim formed by rear ends of each of said ribs, vertical walls, and floors transitioning to a downwardly arcuate shape, whereby said front rim, rear rim, left rim, and right rim comprise one continuous perimetral rim;

the front ends of each of said vertical walls constructed with co-axial circular apertures, the common axis of said apertures running proximate, and parallel to, the front end of said lid, and the rear ends of each of said vertical walls constructed with co-axial circular apertures, the common axis of said apertures running proximate, and parallel to, the rear end of said lid; whereby the lid rod may be inserted sequentially through each of said co-axial circular apertures, in either the front end or the rear end of said lid and secured thereto, therein providing a hinge axis for rotating said lid and exposing the entirety of the opening of the dumpster, garbage receptacle, or trash bin and also for closure of said lid, said hinge axis functioning by virtue of either securement of the lid rod to the front end of said lid or securement of the lid rod to the rear end of said lid, at the option of a user of said dumpster, garbage receptacle, or trash bin.

3. A lid for attachment atop dumpsters, garbage receptacles, and trash bins, said dumpsters, garbage receptacles, and trash bins of the type having a horizontally-oriented circular cross-sectioned lid rod, said lid rod attached parallel to at least one upper edge of said dumpster, garbage receptacle, or trash bin, said lid having an outer surface, an inner surface, a front end which is attachable to said lid rod, a left side, a rear end which is attachable to said lid rod, and a right side, the lid further comprising:

a rectangular-shaped structure having, when viewed in a horizontal orientation, five essentially horizontal, equal-length, parallel ribs running along a long dimension of the structure, each rib inherently defined by a downwardly vertical, lengthwise left wall, and a downwardly vertical, lengthwise right wall, a front end, a rear end, and, with the exception of, a leftmost rib and a rightmost rib, each left wall and right wall orthogonally and integrally joined to a horizontal, lengthwise floor running the same length as each of said ribs;

the leftmost and rightmost ribs constructed with outer vertical walls, said walls being orthogonally and integrally joined to a lengthwise horizontal left flange and a lengthwise horizontal right flange, respectively, and said left and right flanges further being bent orthogonally downward to form a left rim and a right rim, respectively;

a vertically-oriented lid front rim formed by front ends of each of said ribs, vertical walls, and floors transitioning to a downwardly arcuate shape and a vertically-oriented lid rear rim formed by rear ends of each of said ribs, vertical walls, and floors, transitioning to a downwardly arcuate shape, whereby said front rim, rear rim, left rim, and right rim comprise one continuous perimetral rim;

the lid front rim further constructed with the integral attachment of five symmetrically-spaced barrel hinges, all said barrel hinges having horizontal co-axial through-holes, the common axis of said through-holes running proximate, and parallel to the lid front rim and the lid rear rim constructed with the integral attachment of five symmetrically-spaced barrel hinges, all said barrel hinges having horizontal co-axial through-holes, the common axis of said apertures running proximate, and parallel to the lid rear rim; whereby the lid rod may be inserted sequentially through each of said co-axial through-holes of said barrel hinges, at either the front rim or the rear rim of said lid and secured thereto, therein providing a hinge axis for rotating the lid and exposing the entirety of the opening of the dumpster, garbage receptacle, or trash bin and also for closure of said lid, said hinge axis functioning by virtue of either securement of the lid rod to the barrel hinges of said front end of said lid or securement of the lid rod to the barrel hinges of the rear end of said lid, at the option of a user of said dumpster, garbage receptacle, or trash bin.

4. An improved lid of the type commonly attached atop dumpsters, garbage receptacles, and trash bins, said dumpsters, garbage receptacles, and trash bins of those types having a horizontally-oriented circular cross-sectioned lid rod, said lid rod attached parallel to at least one upper edge of said dumpster, garbage receptacle, or trash bin, wherein the improvement comprises:

the lid having both a front end which is attachable to said lid rod, and also a rear end which is attachable to said lid rod by the same mechanism as the front end, wherein the front end and the rear end of said lid are constructed in the manner of a) a rectangular-shaped structure having, when viewed in a horizontal orientation, essentially horizontal, equal-length, parallel ribs running along a long dimension of the structure, each rib inherently defined by a downwardly vertical, lengthwise left wall, and a downwardly vertical, lengthwise right wall, a front end, a rear end, and, with the exception of the leftmost and rightmost ribs, each left wall and right wall orthogonally and integrally joined to a horizontal, lengthwise floor running the same length as each of said ribs;

b) a leftmost rib and a rightmost rib constructed with outer vertical walls, said walls being orthogonally and integrally joined to a lengthwise horizontal left flange and lengthwise horizontal right flange, respectively, and said left and right flanges further being bent orthogonally downward to form a left rim and a right rim, respectively; further c) a vertically-oriented lid front rim formed by front ends of each of said ribs, vertical walls, and floors transitioning to a downwardly arcuate shape and a vertically-oriented lid rear rim formed by rear ends of each of said ribs, vertical walls, and floors transitioning to a downwardly arcuate shape, whereby said front rim, rear rim, left rim, and right rim comprise one continuous perimetral rim;

d) the front ends of each of said vertical walls constructed with co-axial circular apertures, the common axis of said apertures running proximate and parallel to, the front end of said vertical walls, and the rear end of said lid constructed with co-axial circular apertures, the common axis of said apertures running proximate and parallel to, the rear end of said lid; whereby e) the lid rod may be inserted sequentially through each of said co-axial circular apertures, in either the front end or the rear end of said lid and secured thereto, therein providing a hinge axis for rotating said lid and exposing the entirety of the opening of the dumpster, garbage receptacle, or trash bin and also for closure of said lid, said hinge axis functioning by virtue of either securement of the lid rod to the front end of said lid or securement of the lid rod to the rear end of said lid, at the option of a user of said dumpster, garbage receptacle, or trash bin.

* * * * *